US007725053B2

(12) United States Patent
Aratachi et al.

(10) Patent No.: US 7,725,053 B2
(45) Date of Patent: May 25, 2010

(54) FIXING UNIT HAVING HEATER ROLLER AND PRESSURE ROLLER SUPPORTS AND IMAGE-FORMING DEVICE USING THE SAME

(75) Inventors: Tomitake Aratachi, Nagoya (JP); Terumasa Ito, Ama-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 334 days.

(21) Appl. No.: 11/178,465

(22) Filed: Jul. 12, 2005

(65) Prior Publication Data

US 2006/0008282 A1 Jan. 12, 2006

(30) Foreign Application Priority Data

Jul. 12, 2004 (JP) ..... 2004-204656
Jul. 12, 2004 (JP) ..... 2004-205330

(51) Int. Cl.
*G03G 15/16* (2006.01)

(52) U.S. Cl. ..... 399/122

(58) Field of Classification Search ..... 399/33, 399/122, 328, 330, 335; 219/216, 469, 471, 219/510, 517, 251, 253
See application file for complete search history.

(56) References Cited

U.S. PATENT DOCUMENTS 3,839,692 A * 10/1974 Plasko ..... 337/182
4,760,411 A 7/1988 Ohmura et al.
4,782,359 A * 11/1988 Tomoe ..... 399/122
4,806,970 A 2/1989 Nakatomi et al.
5,206,682 A 4/1993 Yamada et al.

(Continued)

FOREIGN PATENT DOCUMENTS

DE 195 27 807 10/1996

(Continued)

OTHER PUBLICATIONS

Office Action dated Nov. 13, 2007 in European Application No. 05 015 037.4.

(Continued)

*Primary Examiner*—Robert Beatty
(74) *Attorney, Agent, or Firm*—Banner & Witcoff, Ltd

(57) ABSTRACT

A fixing unit of an image-forming device having a heating roller, a pressure roller disposed in confrontation with the heating roller, and a case that rotatably supports the heating roller on both longitudinal ends thereof and covers the heating roller from the side opposite the pressure roller, while leaving the pressure roller exposed. A pair of pressure roller support plates, one end of which is supported on the case, rotatably supports both ends of the pressure roller. With this construction, a more compact fixing unit can be achieved than when the case is configured to cover the heating roller and pressure roller entirely. The fixing unit includes a temperature fuse for restraining abnormal temperature rises in the heating roller, and a temperature fuse cover that extends from an inner wall of the case to provide insulation between the temperature fuse and the heating roller. By integrally forming the temperature fuse cover with the case, it is possible to reduce the manufacturing costs of the fixing unit. Support members may also be provided between a bottom surface of the case and the temperature fuse cover to restrain deformation of the temperature fuse cover.

17 Claims, 12 Drawing Sheets

U.S. PATENT DOCUMENTS

| | | | | | |
|---|---|---|---|---|---|
| 5,359,181 | A | | 10/1994 | Waechtler et al. | |
| 5,481,350 | A | * | 1/1996 | Yasui et al. | 399/328 |
| 5,528,345 | A | | 6/1996 | Hasegawa et al. | |
| 5,708,926 | A | * | 1/1998 | Sagara et al. | 399/122 |
| 5,708,927 | A | | 1/1998 | Etoh et al. | |
| 5,787,319 | A | | 7/1998 | Tomatsu | |
| 5,826,141 | A | * | 10/1998 | Mitsuya | 399/122 |
| 5,835,835 | A | * | 11/1998 | Nishikawa et al. | 399/328 |
| 5,839,042 | A | * | 11/1998 | Tomatsu | 399/328 |
| 5,890,031 | A | * | 3/1999 | Yokota et al. | 399/69 |
| 6,292,638 | B1 | * | 9/2001 | Nagamine et al. | 399/122 |
| 6,463,251 | B2 | * | 10/2002 | Kiuchi | 399/330 |
| 2002/0057919 | A1 | * | 5/2002 | Tomatsu | 399/69 |

FOREIGN PATENT DOCUMENTS

| | | | | |
|---|---|---|---|---|
| JP | 61209473 | | | 9/1986 |
| JP | 63226682 | A | * | 9/1988 |
| JP | H04-067666 | U | | 6/1992 |
| JP | 5-303307 | | | 11/1993 |
| JP | 6-318002 | A | | 11/1994 |
| JP | H08-006415 | A | | 1/1996 |
| JP | 8-305205 | | | 11/1996 |
| JP | 9-281842 | | | 10/1997 |
| JP | 2002-149002 | A | | 5/2002 |
| JP | 2002148987 | A | * | 5/2002 |
| JP | 2002-116653 | | | 8/2002 |
| JP | 2003-076205 | A | | 3/2003 |
| JP | 2004-151232 | A | | 5/2004 |

OTHER PUBLICATIONS

European Search Report corresponding to European Patent Application No. 05015037.4.

European Search Report for corresponding European Patent Application No. 05125037.4.

Office Action issued on Jun. 16, 2008 to corresponding Japanese Patent Application JP 2004-204656. (Partial Translation Only).

Notice of Reasons for Rejection dated Feb. 8, 2010 in Japanese Patent Application No. 2004-205330 and English translation thereof.

* cited by examiner

FIXING UNIT HAVING HEATER ROLLER AND PRESSURE ROLLER SUPPORTS AND IMAGE-FORMING DEVICE USING THE SAME

BACKGROUND CF THE INVENTION

1. Technical Field

The present invention relates to a fixing unit and an image-forming device for fixing toner images that have been transferred onto a paper or other recording medium.

2. Description of the Related Art

Conventionally, electrophotographic image-forming devices, such as laser printers, are equipped with a light-emitting unit including a laser diode for emitting a light beam, and a photosensitive member, the surface of which carries a uniform charge. When the surface of the photosensitive member is exposed to the light beam, electrostatic latent images are formed on the surface of the photosensitive member and the latent images are then developed into visible images with toner. Subsequently, the visible images are transferred onto a paper or other recording medium to form visible toner images thereon.

However, the images transferred onto the recording medium are merely carried to the recording medium by an electrostatic force or dispersion force at this time and can be easily removed from the recording medium. Therefore, a fixing process is required to fix and attach the visible images to the recording medium through a step of applying heat.

A fixing device provided in the image-forming device for fixing images using heat typically includes a heating roller and a pressure roller. As the recording medium passes between the heating roller and the pressure roller, the toner or other developing material is sintered and coalesced by the heat from the heating roller, so as to permeate and become fixed to the recording medium. The heating roller accommodates a heat source, such as a halogen lamp. Since failure if the halogen lamp is fatal to the image-forming device, resulting in a loss of the fixing function, the fixing unit must be configured in such a way as to be easily replaceable. Japanese patent application publication No. HEI 8-305205 discloses a fixing unit integrally configured of a heating roller and a pressure roller that can easily be replaced when malfunctions occur.

Further, in order to prevent the heating roller from rising to an abnormal temperature due to a failure of the heating source, the fixing unit is provided with a temperature fuse that interrupts the supply of power to the heating roller when the surface of the heating roller reaches an abnormal temperature.

Normally, the temperature fuse is fixed to contact points provided on a main fuse body by a synthetic resin disposed around the contact points in order to electrically connect these points. Upon reaching a prescribed fusing temperature, the resin melts, causing a spring provided in the fuse to break the connection between contact points and halt the supply of power. Since the temperature fuse is connected to the power source in this case, the temperature fuse is required not to electrically contact the heating roller. Normally, safety standard for electronic equipment (explosion-proof construction standards for general electronic equipment) stipulate that a distance of at least 4 mm should be maintained between the fuse and heating roller as an insulating distance.

Proposals have been made for technologies that interpose a fuse cover between the heating roller and the temperature fuse so as to reliably insulate the two. For example, Japanese patent application publication No. HEI 9-281842 discloses a fixing unit in which a temperature fuse is attached to the underside surface of an electrically insulated member having a heat collecting surface opposing the heating roller.

In Japanese patent application publication No. HEI 9-281842, the fuse cover is provided as a separate member. After the temperature fuse is attached to the fuse cover, the fuse cover is mounted in the fixing device. This assembling way may increase a cost of the image-forming device.

Further, the fixing unit of Japanese patent application publication No. HEI 8-305205 strictly regulates the relationship between the position of the fuse on the fuse cover and the fixing device. Accordingly, the fuse cover is not sometime appropriately mounted in the fixing device if there is any variation in the lengths of the leads on both ends of the temperature fuse.

SUMMARY

In view of the foregoing, it is an object of the present invention to provide a fixing unit and an image-forming device that are conducive to a compact size.

It is another object of the present invention to provide a fixing unit capable of reducing manufacturing costs.

It is a further object of the present invention to provide a fixing unit capable of suppressing deformation, such as warping, of a plate-shaped member used as a fuse cover.

The present invention provides a fixing unit having a heating roller, a pressure roller, a case, and a pair of support members. The heating roller has a rotational axis having two ends, and a cylindrical surface. The pressure roller has a rotational axis having two ends, and a cylindrical surface. The pressure roller is disposed in confrontation with the heating roller to press the cylindrical surface of the pressure roller against the cylindrical surface of the heating roller. The case has two sides rotatably supporting the two ends of the heating roller. The case covers the heating roller on an opposite side of the pressure roller. The pair of support members is supported on the two sides of the case for rotatably supporting the pressure roller. The heating roller rotates to convey a recording medium in cooperation with the pressure roller.

BRIEF DESCRIPTION OF THE DRAWINGS

The above and other objects, features, and advantages of the invention will become more apparent from reading the following description of the preferred embodiments taken in connection with the accompanying drawings in which.

DESCRIPTION OF THE EMBODIMENT

An image-forming device according to a preferred embodiment of the present invention will be described while referring to the accompanying drawings.

(1) Overall Structure of a Laser Printer

Figure 1:
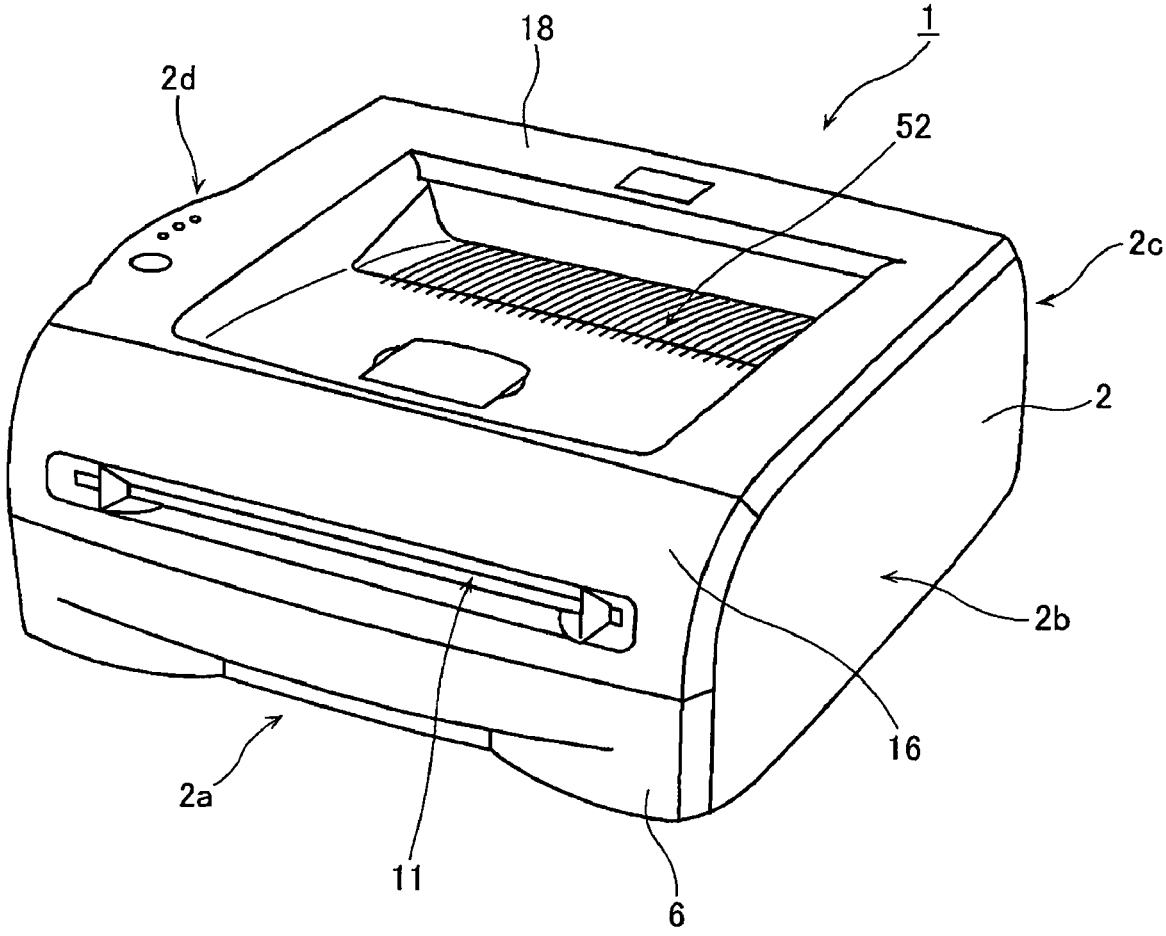
FIG. 1 is a perspective view showing an exterior of a laser printer according to the present invention.

Referring to FIG. 1, a laser printer 1 includes a casing 2 having a top cover 18 forming the top surface of the casing 2, and four side surfaces 2*a*, 2*b*, 2*c*, and 2*d* (side surfaces 2*c* and 2*d* are not visible in FIG. 1) A portion of the top cover 18 is recessed inward to form a sheet discharge tray 52. A paper cassette 6 is provided in the bottom section of the casing 2 and can be inserted into or removed from the casing 2 through the front side surface 2*a*. The paper cassette 6 can accommodate a plurality of sheets of paper or other recording medium. The front side surface 2*a* also includes a front cover 16 that can swing open or closed on the front of the casing 2, and a manual feed tray 11 provided on the front cover 16 for hand feeding a recording medium one sheet at a time.

Figure 2:
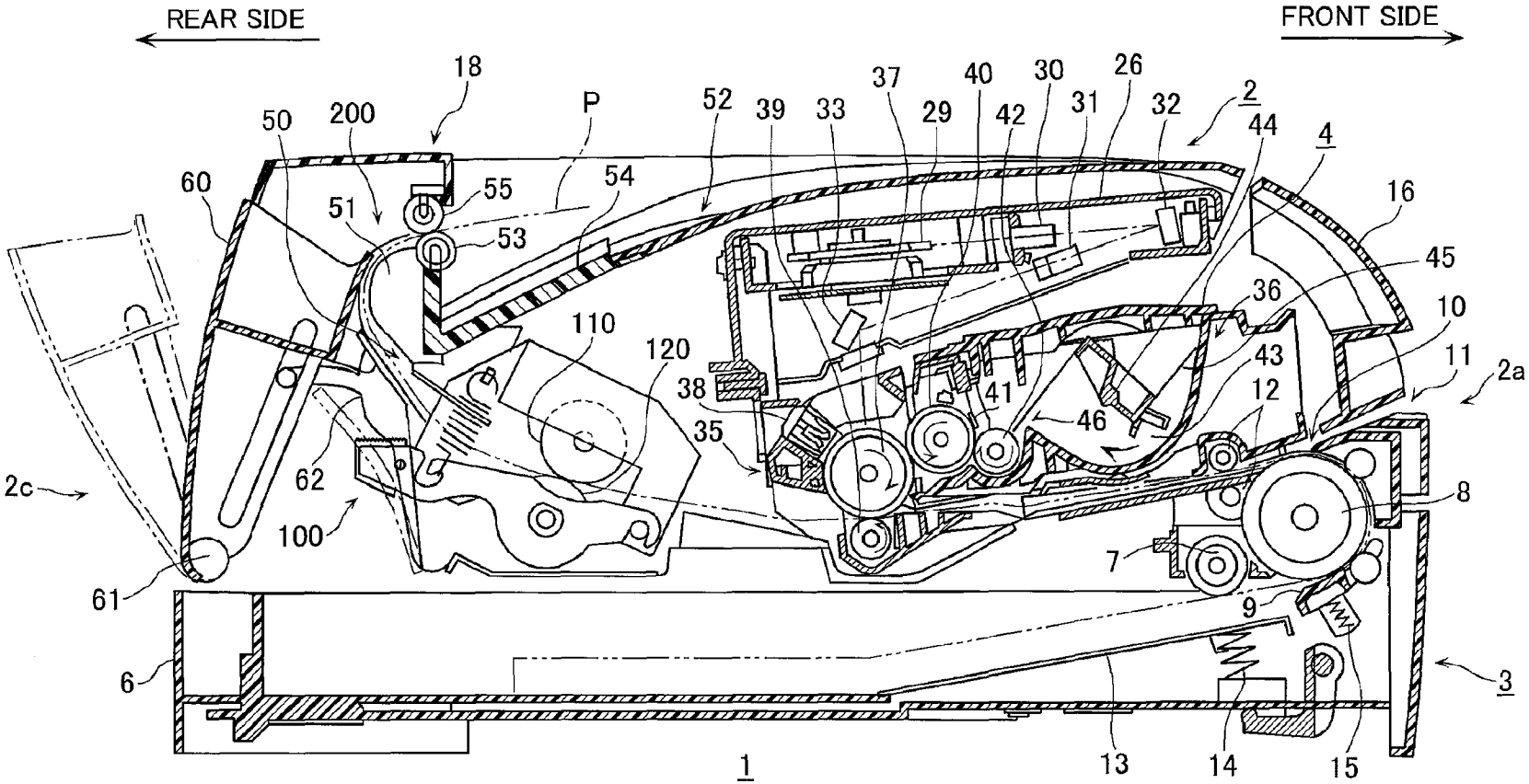
FIG. 2 is a side cross-sectional view showing the laser printer from the side surface.

Next, the structure of the laser printer 1 will be described in detail with reference to the FIG. 2. The laser printer 1 includes the casing 2 having the top cover 18 on the top surface, the front cover 16 provided on the front side surface 2*a*, and a rear cover 60 provided on the side surface 2*c*. Also accommodated in the casing 2 are a paper feed unit 3 for supplying a paper or other recording medium (the path of the recording medium is represented by a broken line P); a process cartridge 4 for forming visible toner images on the paper conveyed from the paper feed unit 3; a fixing unit 100 for fixing the toner image to the paper; and a paper discharge unit 200 for discharging the paper which has passed through the fixing unit 100. In the preferred embodiment, the side surface near the fixing unit 100 on the left side in FIG. 2 is the rear side surface 2*c*, while the side surface opposing the rear side surface 2*c* is the front side surface 2*a*.

The paper feed unit 3 includes the paper cassette 6; and feeding rollers 7 and 8, and a separating pad 9 disposed above the leading edge of the paper stacked in the paper cassette 6 with respect to the paper conveying direction (front surface side of the laser printer 1). A paper feeding path 10 is formed in the paper feed unit 3 for reversing the direction of the sheets of paper fed from the paper cassette 6 and conveying the paper along the bottom of the process cartridge 4. A pair of registration rollers 12 is provided in the paper feed unit 3 and straddle the paper feeding path 10. Whether the paper is fed onto the paper feeding path 10 from paper stacked in the paper cassette 6 or from a sheet hand fed into the manual feed tray 11, the registration rollers 12 initially stops progress of the sheet of paper before ejecting the sheet to image-forming units in the process cartridge 4 in synchronization with the image-forming timing in the process cartridge 4.

The paper cassette 6 is disposed below the process cartridge 4 and the fixing unit 100 and can be inserted into and removed from the casing 2 through the front side surface thereof. The paper cassette 6 accommodates a paper pressing plate 13 and a spring 14 disposed on the underside of the paper pressing plate 13 for urging an end of the paper pressing plate 13 nearest the feeding roller 7 upward. The paper pressing plate 13 is capable of pivoting about an end farthest from the feeding roller 7 so that the end of the paper pressing plate 13 nearest the feeding roller 7 can move up and down to accommodate sheets of a recording medium stacked on the paper feed unit 3. As the amount of paper stacked on the paper pressing plate 13 increases, the end of the paper pressing plate 13 nearest the feeding roller 7 opposes the urging force of the spring 14 and pivots downward about the end farthest from the feeding roller 7.

The feeding roller 8 and the separating pad 9 are disposed in confrontation with each other. A spring 15 is disposed on the underside of the separating pad 9 for urging the separating pad 9 toward the feeding roller 8. The spring 14 on the underside of the paper pressing plate 13 urges the paper pressing plate 13 so that the topmost sheet of paper stacked on the paper pressing plate 13 is pressed against the feeding roller 7. The feeding roller 7 feeds the topmost sheet to a position between the feeding roller 8 and the separating pad 9. The feeding roller 8 rotates to feed the topmost sheet onto the paper feeding path 10, while the cooperative operations of the feeding roller 8 and separating pad 9 ensure that the sheets are separated and fed one sheet at a time.

A sheet of paper supplied from the paper cassette 6 or the manual feed tray 11 is conveyed to the registration rollers 12 disposed above the feeding roller 7. The registration rollers 12 first register the sheet and then convey the sheet to an image-forming position beneath the process cartridge 4 (a contact position between a photosensitive drum 37 and a transfer roller 39 described later). As mentioned earlier, the front cover 16 is provided on the front side surface 2*a* of the casing 2 and is freely opened and closed or the casing 2. When the front cover 16 is in an open state, an opening is revealed in the casing 2 through which the process cartridge 4 can be inserted or removed.

A scanning unit 26 is disposed above the process cartridge 4. The scanning unit 26 includes a laser light-emitting unit (not shown), a polygon mirror 29 that is driven to rotate at a high speed, a first scanning lens (fθ lens) 30, a second scanning lens (cylindrical lens) 31, and reflecting mirrors 32 and 33. The laser light-emitting unit emits a laser beam that is modulated according to image data. As indicated by the broken line in the scanning unit 26 of the drawing, the laser beam passes through or is reflected off the polygon mirror 29, first scanning lens 30, reflecting mirror 32, second scanning lens 31, and reflecting mirror 33 in the order given and is scanned over the surface of a photosensitive drum 37 in the process cartridge 4.

The process cartridge 4 includes a drum cartridge 35 and a developing cartridge 36. The drum cartridge 35 accommodates the photosensitive drum 37, a charger 38, and a transfer roller 39. As described above, the process cartridge 4 is freely mounted in and removed from the main frame 2 via the opening in the casing 2 when the front cover 16 is open. The developer cartridge 36 is detachably mounted on the drum cartridge 35 and includes a developing roller 40, a thickness regulating blade 41, a supply roller 42, and a toner hopper 43.

The toner hopper 43 accommodates toner. The toner hopper 43 has a toner supply opening 46 formed in a side thereof and houses a rotational shaft 44 and an agitator 45 rotatably supported on the rotational shaft 44. The agitator 45 is driven to rotate in the direction of the arrow shown in FIG. 2 to agitate the toner accommodated in the toner hopper 43 so that some of the toner is discharged through the toner supply opening 46 formed in the side of the toner hopper 43. The supply roller 42 is rotatably disposed at a position to the side of the toner supply opening 46. The developing roller 40 is rotatably disposed in confrontation with the supply roller 42 and contacts the supply roller 42 with sufficient pressure so that the developing roller 40 and supply roller 42 compress to a degree.

The developing roller 40 is configured of a metal roller shaft covered by a roller formed of an electrically conductive rubber material. The developing roller 40 is driven to rotate in the direction indicated by the arrow (counterclockwise in FIG. 2). A developing bias is applied to the developing roller 40. The thickness regulating blade 41 is disposed near the developing roller 40 and includes a main blade member configured of a metal leaf spring member, and a pressing part provided on a distal end of the main blade member. The pressing part has a semicircular cross section and is formed of an insulating silicon rubber. The thickness regulating blade 41 is supported on the developer cartridge 36 rear the developing roller 40 so that the elastic force of the main blade member causes the pressing part to contact the developing roller 40 with pressure.

Toner discharged through the toner supply opening 46 is supplied to the developing roller 40 by the rotation of the supply roller 42. At this time, the toner is positively tribocharged between the supply roller 42 and the developing roller 40. As the developing roller 40 rotates, the toner supplied onto the surface of the developing roller 40 passes between the thickness regulating blade 41 and the developing roller 40, thereby maintaining a uniform thickness on the surface of the developing roller 40.

The photosensitive drum 37 is disposed to the side of the developing roller 40 and rotates in the drum cartridge 35 in the direction indicated by the arrow (clockwise in FIG. 2) while in confrontation with the developing roller 40. The photosensitive drum 37 is configured of a main drum body that is grounded and a surface layer formed of a positive charging photosensitive layer of polycarbonate.

The charger 38 is disposed diagonally above and to the left (in FIG. 2) of the photosensitive drum 37, confronting the photosensitive drum 37 and separated a prescribed distance therefrom. The charger 38 is a positive charging Scorotron charger having a charging wire formed of tungsten from which a corona discharge is generated. The charger 38 functions to charge the entire surface of the photosensitive drum 37 with a uniform positive polarity.

The transfer roller 39 is disposed below the photosensitive drum 37 and in opposition thereto, and is supported in the drum cartridge 35 so as to be capable of rotating in the direction indicated by the arrow (counterclockwise in FIG. 2). The transfer roller 39 includes a metal roller shaft covered by a roller that is formed of an electrically conductive rubber material. A transfer bias is applied to the transfer roller 39 during a transfer operation.

As the photosensitive drum 37 rotates, the charger 33 charges the surface of the photosensitive drum 37 with a uniform positive polarity. Subsequently, the surface of the photosensitive drum 37 is exposed to a laser beam emitted from the scanning unit 26, forming an electrostatic latent image on the surface of the photosensitive drum 37. Next, the positively charged toner carried on the surface of the developing roller 40 is brought into contact with the photosensitive drum 37 as the developing roller 40 rotates. At this time, due to the developing bias applied to the developing roller 40, the latent image formed on the surface of the photosensitive drum 37 is developed into a toner image when the toner is selectively attracted to portions of the photosensitive drum 37 that were exposed to the laser beam and, therefore, have a lower potential than the rest of the surface having a uniform positive charge. In this way, a reverse developing process is achieved.

Subsequently, the toner image carried on the surface of the photosensitive drum 37 is transferred onto the paper due to the transfer bias applied to the transfer roller 39, as the sheet of paper passes between the photosensitive dream 37 and the transfer roller 39.

The fixing unit 100 is disposed above the paper cassette 6 and to the side and downstream of the process cartridge 4 with respect to the paper conveying direction. The fixing unit 100 includes a heating roller 110, and a pressure roller 120 disposed in confrontation with the heating roller 110 and urged to contact the heating roller 110 with pressure. The heating roller 110 accommodates an internal heater.

After a visible toner image is transferred onto a sheet of paper at the process cartridge 4, the toner image is fixed to the sheet in the fixing unit 100 by the heat of the heating roller 110 as the sheet passes between the heating roller 110 and the pressure roller 120. Subsequently, the heating roller 110 and pressure roller 120 convey the sheet onto a paper discharge path 50 formed in the paper discharge unit 200.

The paper discharge unit 200 includes an inner guide member 51 and an outer guide member 62 that form the paper discharge path 50; a lower discharge roller 53 and an upper discharge roller 55 forming a pair of discharge rollers disposed in a discharge opening through which the paper is discharged onto the sheet discharge tray 52 provided on the top cover 18; and a tray member 54 constituting part of the sheet discharge tray 52. The outer guide member 62 that functions to configure the paper discharge path 50 moves in association with the opening and the closing of the rear cover 60 provided on the rear side surface of the casing 2. The rear cover 60 is attached to the casing 2 via a hinge 61 and is capable of swinging open and closed about the hinge 61. When the rear cover 60 is swung to an open position, the top portion of the outer guide member 62 pivots rearward in association. In this way, the paper discharge path 50 can be exposed through the opening formed in the rear side surface 2*c* by opening the rear cover 60.

The discharge tray 52 is substantially rectangular in shape in a plan view. The rear end of the discharge tray 52 is formed as a depression that recedes into the casing 2 and slopes gradually upward toward the front surface side of the casing 2. In this embodiment, a section of the sheet discharge tray 52 that slopes gradually upward from the rear end to a point in the middle of the sheet discharge tray 52 is configured by the tray member 54. The top surface of the tray member 54 on the front end (the downstream end with respect to the paper conveying direction) is configured to contact the bottom surface of the top cover 18.

Hence, after passing through the fixing unit 100, the sheet of paper is conveyed along the paper discharge path 50. The paper discharge path 50, configured by the inner guide member 51 and the outer guide member 62, reverses the conveying direction of the sheet so that the sheet is directed toward the pair of discharge rollers 53 and 55. The discharge rollers 53 and 55 discharge the sheet of paper onto the sheet discharge tray 52 toward the front surface side of the casing 2.

(2) Detailed Structure of the Fixing Unit 100

Figure 3:
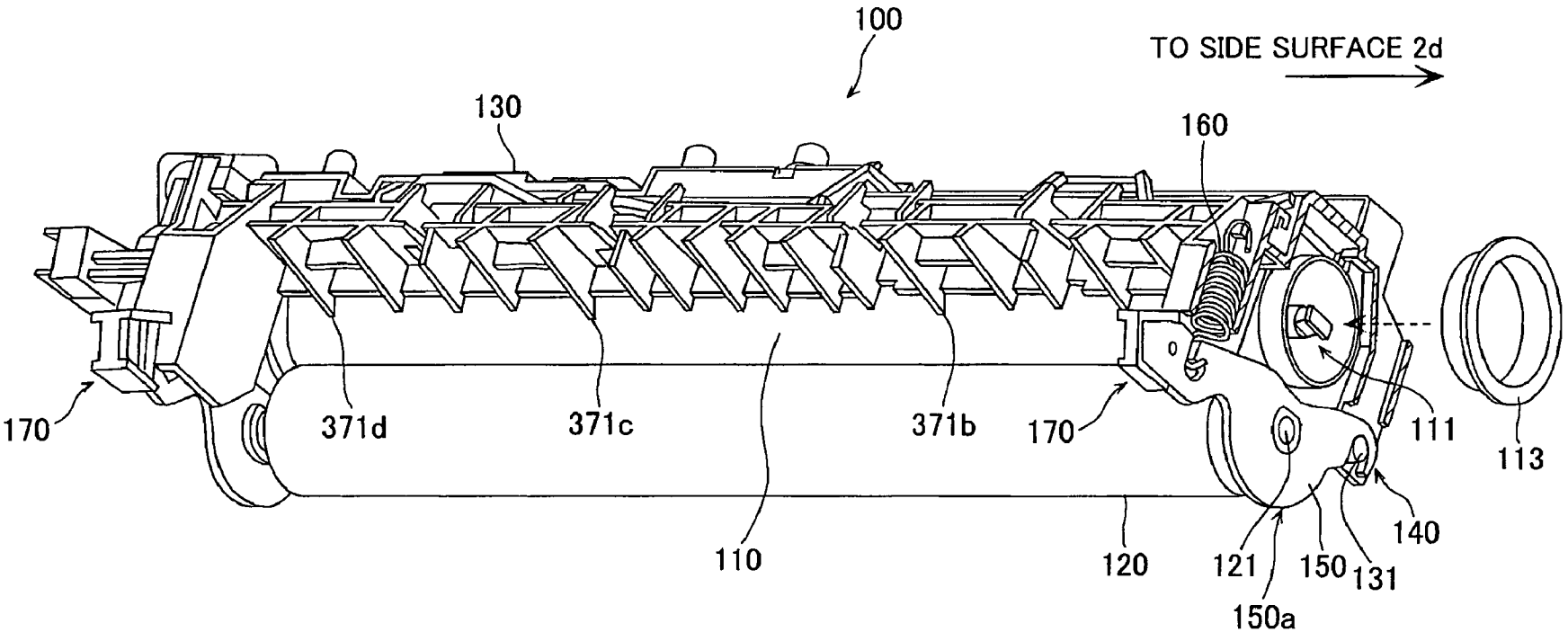
FIG. 3 is a perspective view illustrating a fixing unit provided in the laser printer of FIG. 1.

Next, the structure of the fixing unit 100 will be described in detail. Referring to FIG. 3, the fixing unit 130 includes the heating roller 110, the pressure roller 120 disposed beneath the heating roller 110 and pressing against the heating roller 110, a support plate 150 for assembling the pressure roller 120 with the heating roller 110.

The heating roller 110 is configured of a metal cylinder accommodating a heater in the form of a halogen lamp, for example, that functions to heat the metal cylinder. The both open ends of the heating roller 120 are sealed with bearing 113, respectively.

The pressure roller 120 has an elastic cylinder made of silicon rubber and a film of polytetrafluoroethylene (PTFE) wound around the elastic cylinder. The pressure roller 120 has a rotational shaft 121 extending through the center axis of the elastic cylinder. Alternatively, the pressure roller 120 may be made by inserting an elastic cylindrical member of silicon rubber into a tube of PTFE. The pressure roller 120 follows the rotation of the heating roller 110 while applying pressure to the same.

Figure 4:
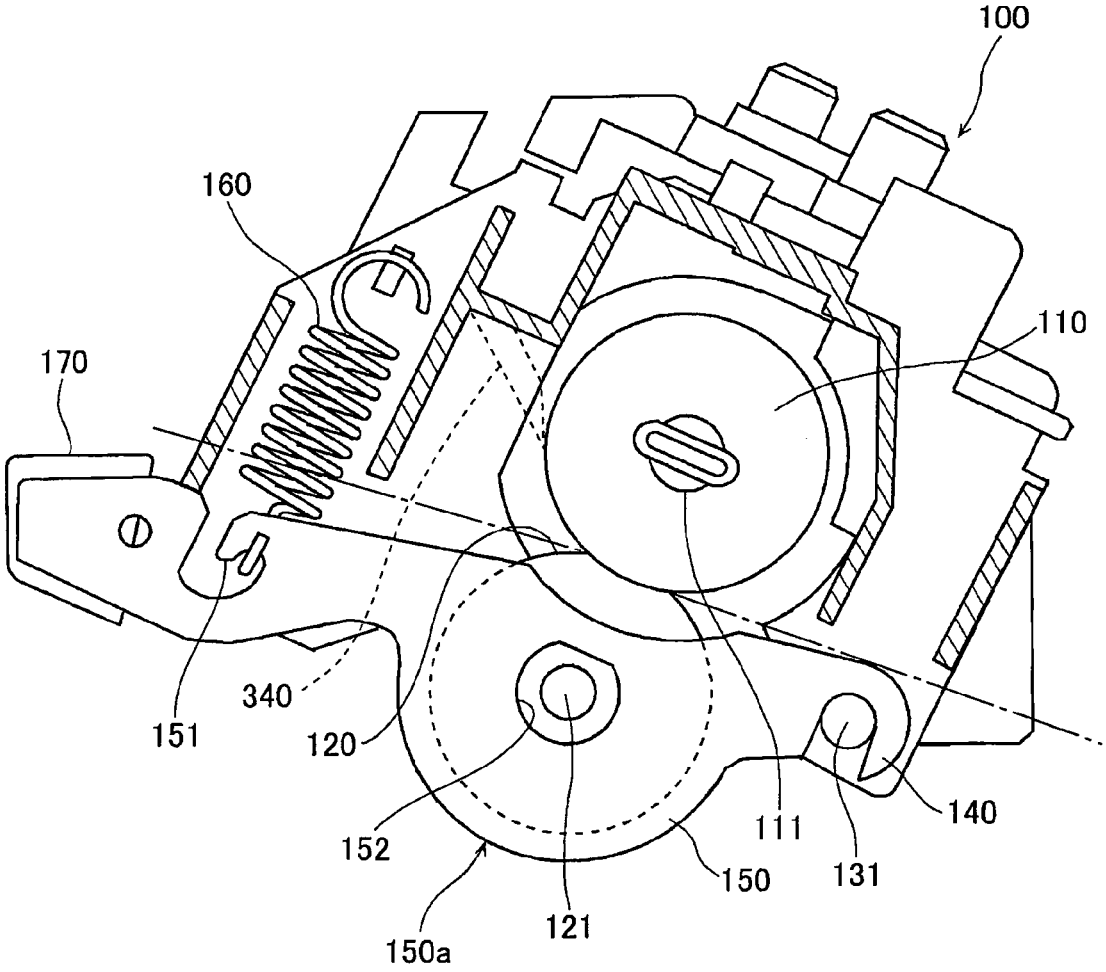
FIG. 4 is a partially cross-sectional view showing the fixing unit.

Referring to FIG. 4, the support plate 150 extends in the paper conveying direction and has a support portion 140, a lower arc-shaped portion 150*a*, and a grip 170 in the paper conveying direction. The support portion 140 has a hook-shape on the upstream end with respect to the paper conveying direction. The grip 170 is provided on the downstream end.

The support portion 140 is engaged with a support shaft 131 formed on the cover 130 and rotatably supported by the cover 130 so that the support plate 150 is supported and capable of rotating with respect to the cover 130. The support plate 150 has a notch 151 formed between the lower arc-shaped portion 150*a* and the grip 170. A spring 160 has one end engaged with the notch 151 and the other end engaged with the cover 130 to press the pressure roller 120 against the heating roller 110. In other words, the restorative force of the spring 160 urges the pressure roller 120 toward the heating roller 110.

The lower arc-shaped portion 150*a* has a bearing portion 152 to pivotably receive one end of the rotational shaft 121 of the pressure roller 120. The lower arc-shaped portion 150*a* has a shape that extends from the bearing portion 152 beyond the peripheral surface of the pressure roller 120 supported by the bearing portion 151 when viewed from the rotational shaft 121.

The upper portion of the heating roller 110 is covered with a cover 130. The cover 130 is molded of a resin, such as polyethylene teraphthalate (PET). The cover 130 does not cover the pressure roller 120 and, hence, the pressure roller 120 is in an exposed state out of the cover 130. With this construction, the height of the fixing unit 100 can be reduced. Therefore, the fixing unit 100 can be made more compact, contributing to a more compact image-forming device.

The grip 170 is provided for a user of the laser printer 1 to open the rear cover 60 and press down on the grip 170 to easily access the problem happened in the printer 1, when a paper jam occurs in the fixing unit 100.

As described above, the support plate 150 has the lower arc-shaped portion 150*a*. When the fixing unit 100 is placed on a flat surface with the side of the support plates 150 facing downward, the lower arc-shaped part 150*a* contacts the flat surface so that the surface of the pressure roller 120 does not contact the flat surface.

If the surface of the pressure roller 120 is damaged, the fixing strength at the damaged areas differs from the other areas, resulting in irregular fixing. As described above, the bottom of the pressure roller 120 is not covered by the case 130, thereby contributing to the manufacturing of a compact fixing unit 100. However, during maintenance, the fixing unit 100 must be removed from the laser printer and placed on a worktable. Depending on the type of maintenance being performed, there may be some cases in which the fixing unit 100 cannot be placed on the surface with the surface of the pressure roller 120 facing upward. Accordingly, the support plate 150 is provided with the construction described above for preventing the surface of the pressure roller 120 from becoming damaged. However, the support plate may be extended from the case 130 in order to prevent the surface of the pressure roller 120 from contacting the worktable.

(3) Detailed Structure of the Separating Pawls

Next, separating pawls provided in the fixing unit 100 will be described. In order to prevent recording paper or another recording medium that passes between the heating roller 110 and the pressure roller 120 from becoming attached to the heating roller 110 and wrapping around the heating roller 110 inside the case 130, separating pawls are provided in the fixing unit 100 for separating the recording medium from the heating roller 110.

However, various problems may arise from the use of such separating pawls. For example, since the ends of the separating pawls contact the surface of the heating roller, the life of these separating pawls is short and the separating pawls should be replaced relatively frequently. Further, the conveyed recording medium can press against the ends of the separating pawls and cause the pawls to separate from the heating roller 110 accidentally.

Figure 5:
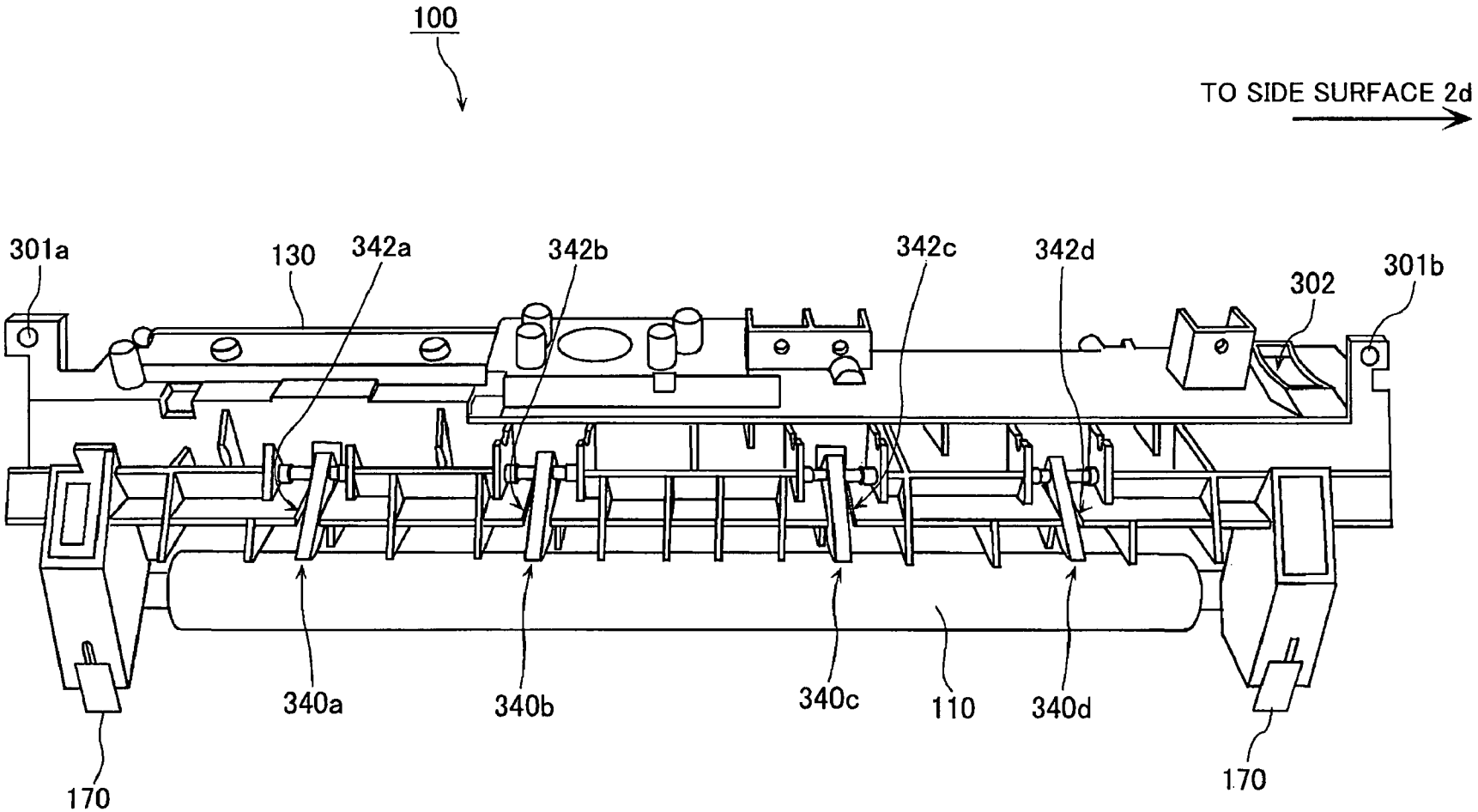
FIG. 5 is a perspective view the fixing unit viewed from the downstream side of the sheet conveying direction.

Referring to FIG. 5, grooves 342*a*, 342*b*, 342*c*, and 342*d* are formed in four locations of the case 130 along the rotational axis of the heating roller 110. Separating pawls 340*a*, 340*b*, 340*c*, and 340*d* are disposed in the respective grooves.

Screw holes 301*a* and 301*b* are formed in the fixing unit 100 for mounting the fixing unit 100 inside the casing 2. An opening 302 is provided in the fixing unit 100 for engaging a drive gear 115 mounted to the heating roller 110 with a transfer gear (not shown). The transfer gear functions to transfer a drive force from a drive motor disposed outside of the fixing unit 100 to the heating roller 110.

Next, the construction of the separating pawls 340*a*-340*d* will be described. Since the four separating pawls 340*a*-340*d* have the same construction, an arbitrary separating pawl will be referred to as a "separating pawl 340"; similarly, the grooves 342*a*-342*d* will be referred to collectively as a "groove 342".

Figure 6:
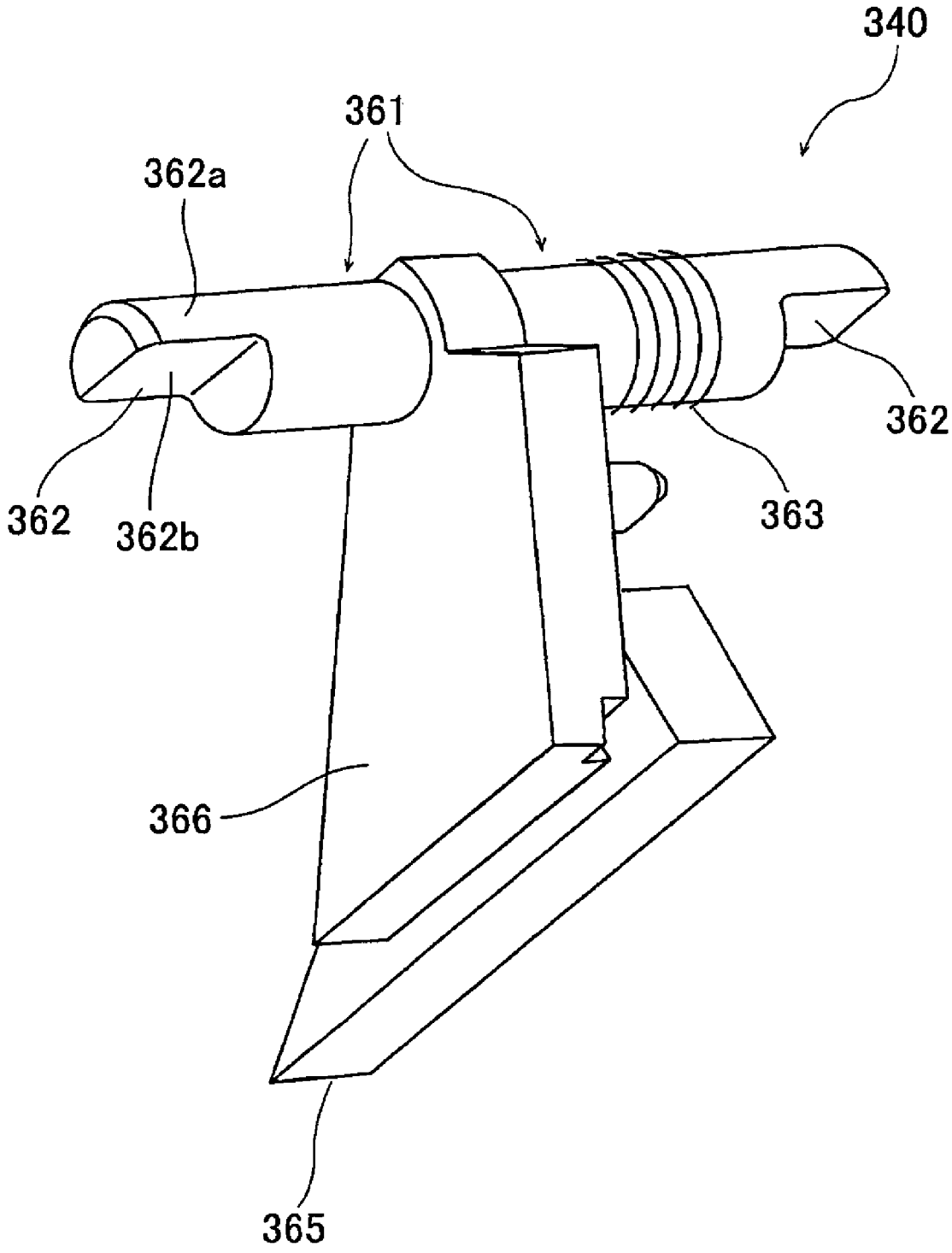
FIG. 6 is an enlarged perspective view of a separating pawl.

Referring to FIG. 6, the separating pawl 340 has a substantially triangle pawl member 366 and a rotational shaft 361 extending in a crossing direction of the pawl member 366. The pawl member 366 has a tip 365 on the acutest angle corner to contact the surface of the heating roller 110. The rotational shaft 361 has two engaged portions 362 on both ends to be engaged with the case 130. The engaged portion 362 has a semicylindrical portion 362*a* and a flat portion 362*b*, and has a semicircular cross-section in a direction crossing the axis of the shaft 361. The flat portion 362*b* faces the surface of the case 130 when the separating pawl 340 is mounted to the case 130 to be in an operable condition. A spring 363 is wound around the rotational shaft 361. The spring 363 generates an elastic force for pressing the tip 365 against the surface of the heating roller 110 when the separating pawl 340 is mounted to the case 130.

Figure 7:
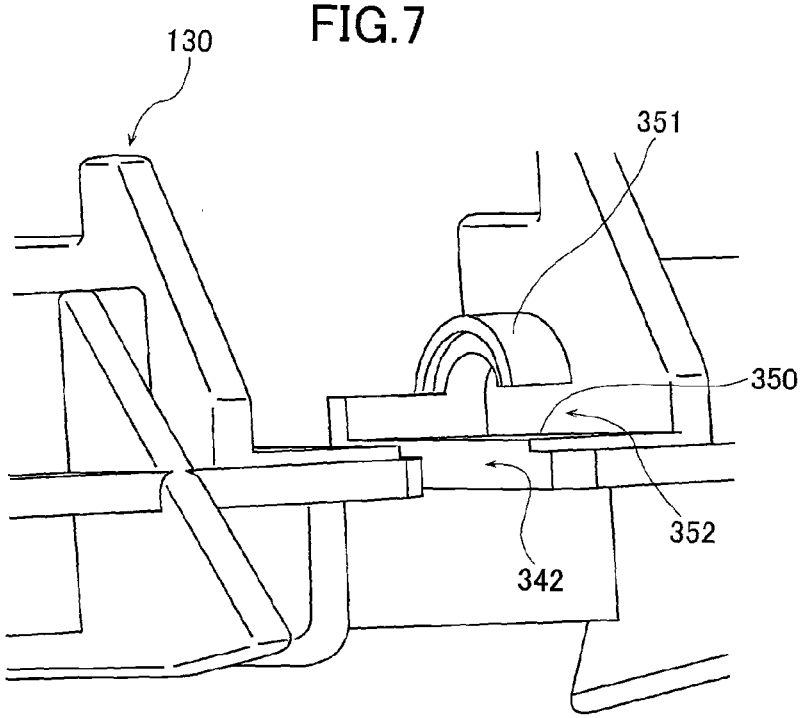
FIG. 7 is a perspective view showing a mounting part on the case of the fixing unit for mounting the separating pawl.

Referring to FIG. 7, the case 130 has semicircular holding parts 351 (only one semicircular holding part 351 is shown in FIG. 7) formed in the mounting portion 350 for engaging and holding the engaged portion 362 of the rotational shaft 361. The semicircular holding part 351 rises from the surface of the mounting portion 350 and curves with the tip of the semicircular holding part 351 facing toward the mounting portion 350. Spaces 352 are between the semicircular holding part 351 and the case 130 for receiving the engaged portion 362. When the separating pawl 340 is mounted, the engaged portions 362 on both ends of the rotational shaft 361 are inserted in the spaces 352.

Figure 8:
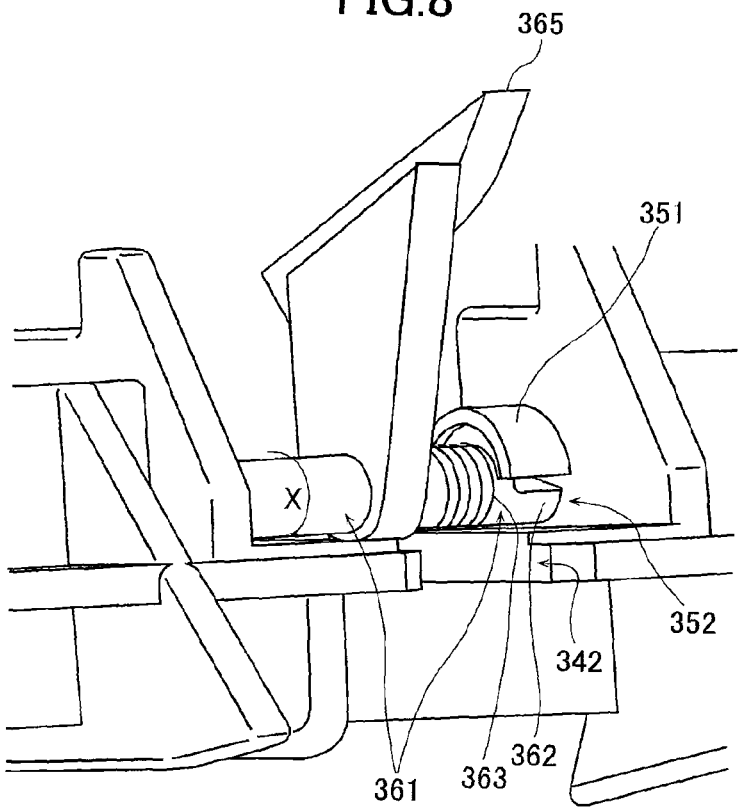
FIG. 8 is a perspective view showing the separating pawl being mounted in the fixing unit.

Referring to FIG. 8, when mounting the separating pawl 340, the engaged portion 362 are inserted into the spaces 352 under the semicircular holding parts 351 while the flat portions 362*b* are facing the semicircular holding parts 351. Subsequently, the separating pawl 340 is rotated about the rotational shaft 361 in a direction indicated by the arrow X until the pawl member 366 of the separating pawl 340 comes into the groove 342. At this time, the semicylindrical portion 362*a* of the separating pawl 340 fits into the semicircular holding parts 351.

By engaging one end of the spring 363 at a prescribed position on the case 130, for example, the tip 365 of the separating pawl 340 can be made to contact the surface of the heating roller 110 with pressure by the elastic force of the spring 363. According to the semicylindrical shape of the engaged portion 362, the separating pawl 340 can be easily and readily mounted to the case 130.

Figure 9:
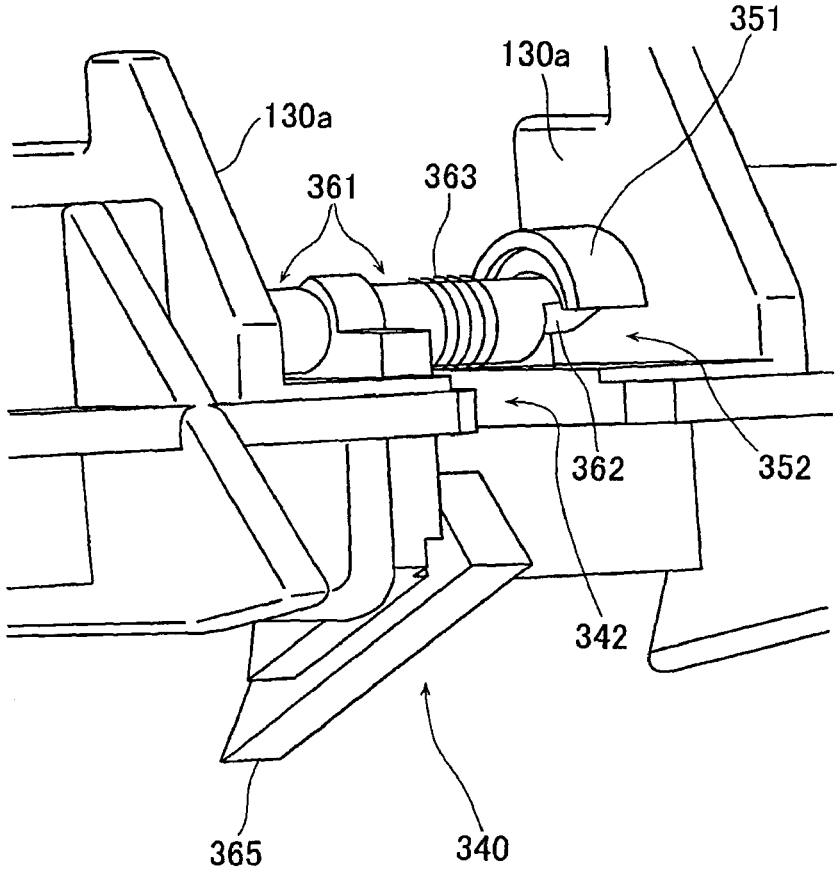
FIG. 9 is a perspective view showing a separating pawl mounted in a groove in the fixing unit.

Referring to FIG. 9, after the separating pawl 340 is mounted, the engaged portions 362 are maintained in the space 352 by the semicircular holding parts 351. Unless the engaged portions 362 are almost completely inverted, the rotational shafts 361 do not remove from the semicircular holding parts 351, even if the leading edge of the recording medium catches on the tips 365.

Alternatively, a covering member for covering the groove 342 can be attached on the inner guide member 51 made integrally with the tray member 54 (referred to as "inner guide members 51" hereinafter). This structure can prevent the separating pawl 340 from removing from the case 130 if the leading edge of the recording medium catches on the separating pawl 340.

(4) Structure of the Separating Ribs

In this embodiment, referring to FIG. 3, separating ribs 371*a*, 371*b*, 371*c*, and 371*d* (the separating rib 371*a* is not shown in FIG. 3) are provided at four locations on the case 130 in addition to the separating pawls 340 described above. Next, the structure of the separating ribs 371*a*-371*d* will be described. All separating ribs 371*a*-271*d* have the same structure and hereinafter will be collectively referred to as a "separating rib 371".

Figure 10:
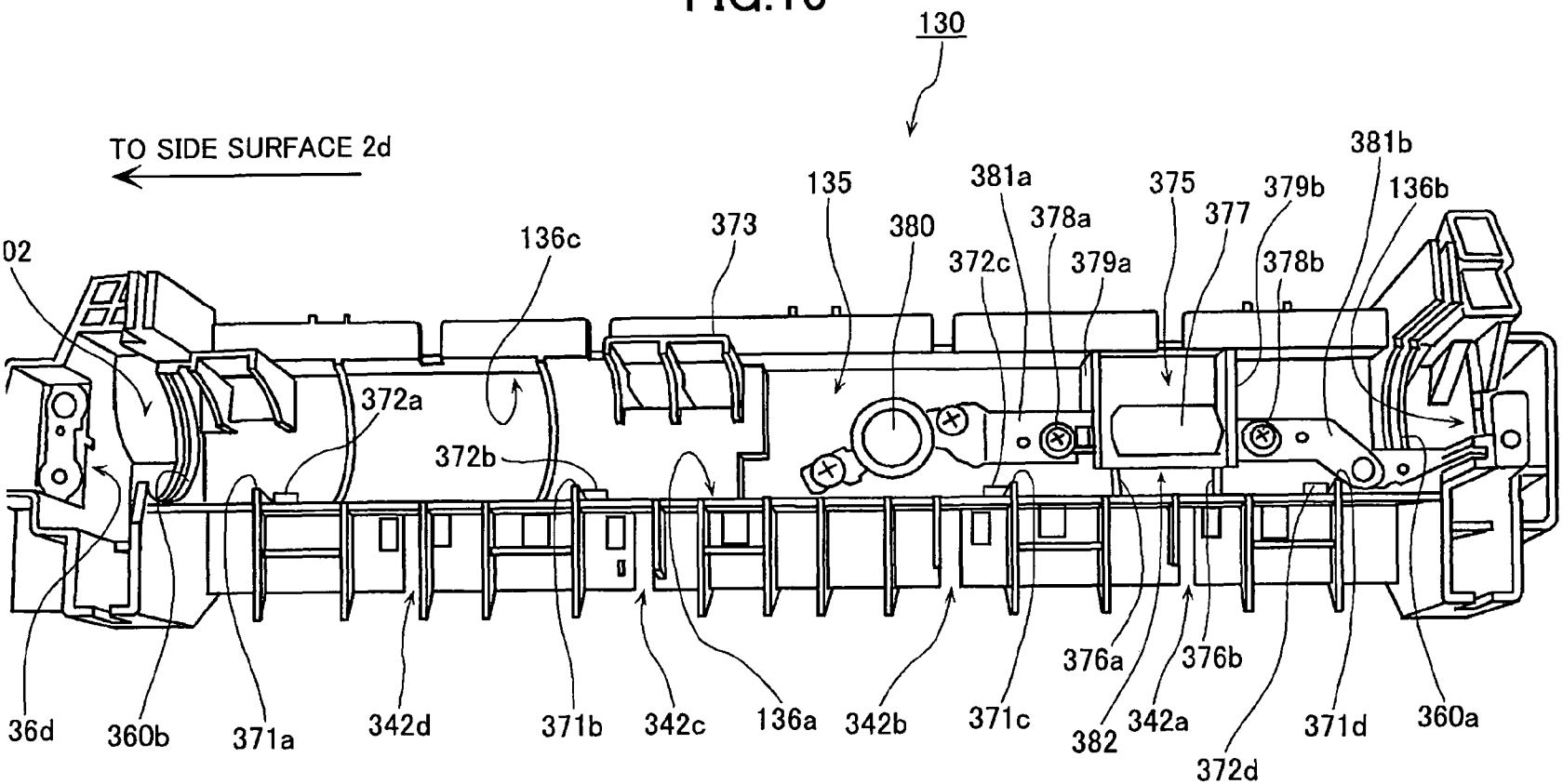
FIG. 10 is a plan view of the case in the fixing unit from the heating roller side, with the heating roller and the like removed.
Figure 11:
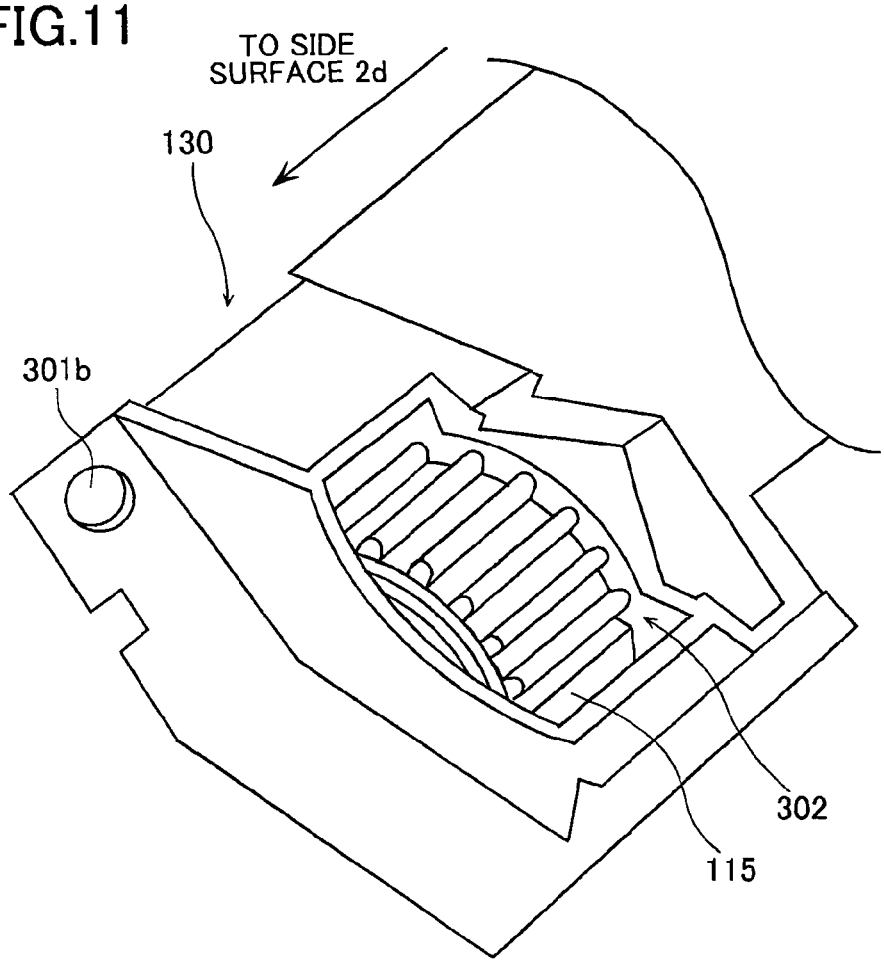
FIG. 11 is an enlarged perspective view showing a drive gear disposed on one end of a heating roller and exposed through an opening of the fixing unit.

Referring to FIG. 10, the case 130 includes a bottom surface 135 substantially rectangular in shape from a plan view and positioned above the fixing unit 100 when the case 130 is mounted in the casing 2; and four side walls 136*a*, 136*b*, 136*c*, and 136*d* erected from each of the four sides of the bottom surface 135 toward the heating roller 110, thereby forming an open box shape for accommodating the heating roller 110. Holding parts 360*a* and 360*b* are formed in both ends of the case 130 for holding the bearings 113 on both ends of the heating roller 110. In FIG. 10, the separating pawls 340 have been removed from the grooves 342. Next, the structure of the case 130 will be described in detail with reference to FIG. 10.

A wind-screening member 373 is integrally formed with the case 130 by injection molding so as to be substantially parallel to the side wall 136*c*. The wind-screening member 373 is plate-shaped and functions to prevent wind from blowing on a thermistor (not shown) provided on the case 130 for measuring the surface temperature of the heating roller 110. A temperature fuse cover 375 is also integrally formed with the case 130 by injection molding. The temperature fuse cover 375 is substantially plate shaped and extends from the side wall 136*c* to provide insulation between the heating roller 110 and a temperature fuse (not shown) provided for preventing the heating roller 110 from rising to an abnormal temperature.

The temperature fuse is mounted on the bottom surface 135 by the temperature fuse cover 375. The temperature fuse has lead wires provided one on each end that are fastened to a power supply line by screws 378*a* and 378*b*. Support members 379*a* and 379*b* are integrally formed with the case 130 by injection molding. The support members 379*a* and 379*b* are positioned between the bottom surface 135 and the both ends of the temperature fuse cover 375, extending in the direction crossing the side wall 136*c*. The support members 379*a* and 379*b* help prevent the plate-shaped temperature fuse cover 375 from warping or otherwise deforming due to heat from the heating roller 110. A tape formed of a thermosetting resin such as polyimide is fixed to the surface of the temperature fuse cover 375. Since the tape does not melt even if the heating roller 110 reaches an abnormal temperature, the tape can prevent the temperature fuse from contacting the heating roller 110. The bearings 113 described above (see FIG. 3) are molded of a resin that melts when the heating roller 110 reaches the abnormal temperature so as to ensure that a thermistat 380 described below and the temperature fuse operate reliably during abnormal heating.

The thermostat 380 is disposed on the power supply line. The thermostat 380 functions to prevent abnormal rises in temperature in the heating roller 110. In this embodiment, the thermostat 380 is set to interrupt the power supply when the surface temperature of the heating roller 110 reaches about 400° C. The temperature fuse is adjusted so as to interrupt the power supply at about 500-600° C. Hence, the temperature fuse is particularly effective when an abnormality occurs in the thermostat 380.

The separating ribs 371 protrude from the side wall 136*a* toward the heating roller 110 at four locations on the downstream side of the case 130 with respect to the sheet conveying direction. While there is no particular restriction in the number and positions of the separating ribs 371, consideration should be given for the size of the recording medium being used (A4, letter). Holes 372*a*, 372*b*, 372*c*, and 372*d* corresponding to the separating ribs 371 age provided for removing the mold after integrally forming the case 130 and separating ribs 371 by injection molding. When providing the holes 372, an appropriate number of separating ribs is set in order to maintain the strength of the case 130.

The separating ribs 371 provided in this way can separate the recording medium from the heating roller 110 even when an aberration occurs in the separating pawls 340. If the material of the recording medium is restricted, the separating palls 340 can be eliminated in order to reduce manufacturing costs.

The opening 302 is formed in the end of the case 130 on the side surface 2*d* side so that a drive gear of the heating roller 110 can engage with a gear for transferring a drive force from a drive motor (not shown). Next, the opening 302 will be described.

Figure 12:
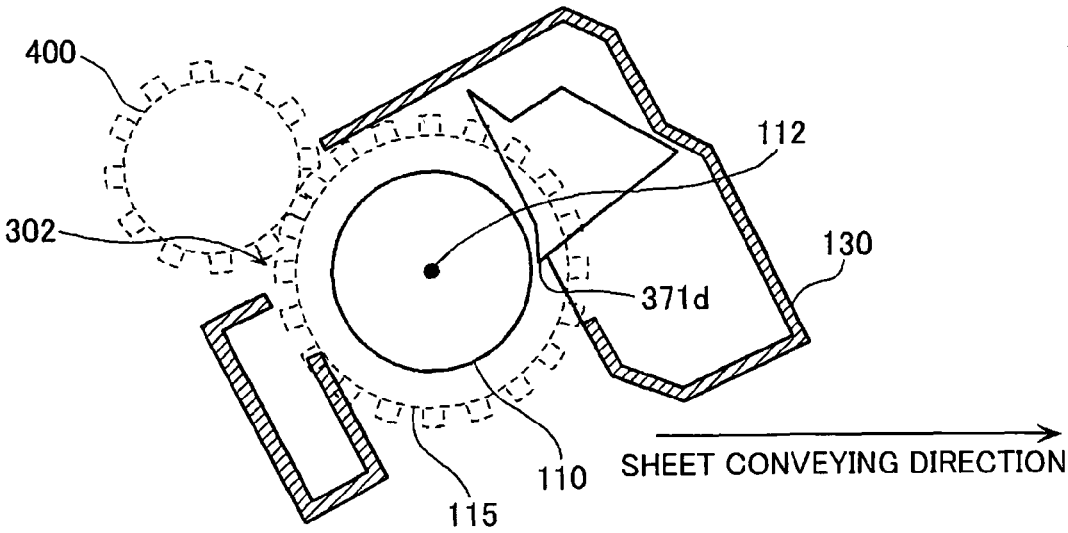
FIG. 12 is a diagram illustrating functions of the drive gear.
Figure 13:
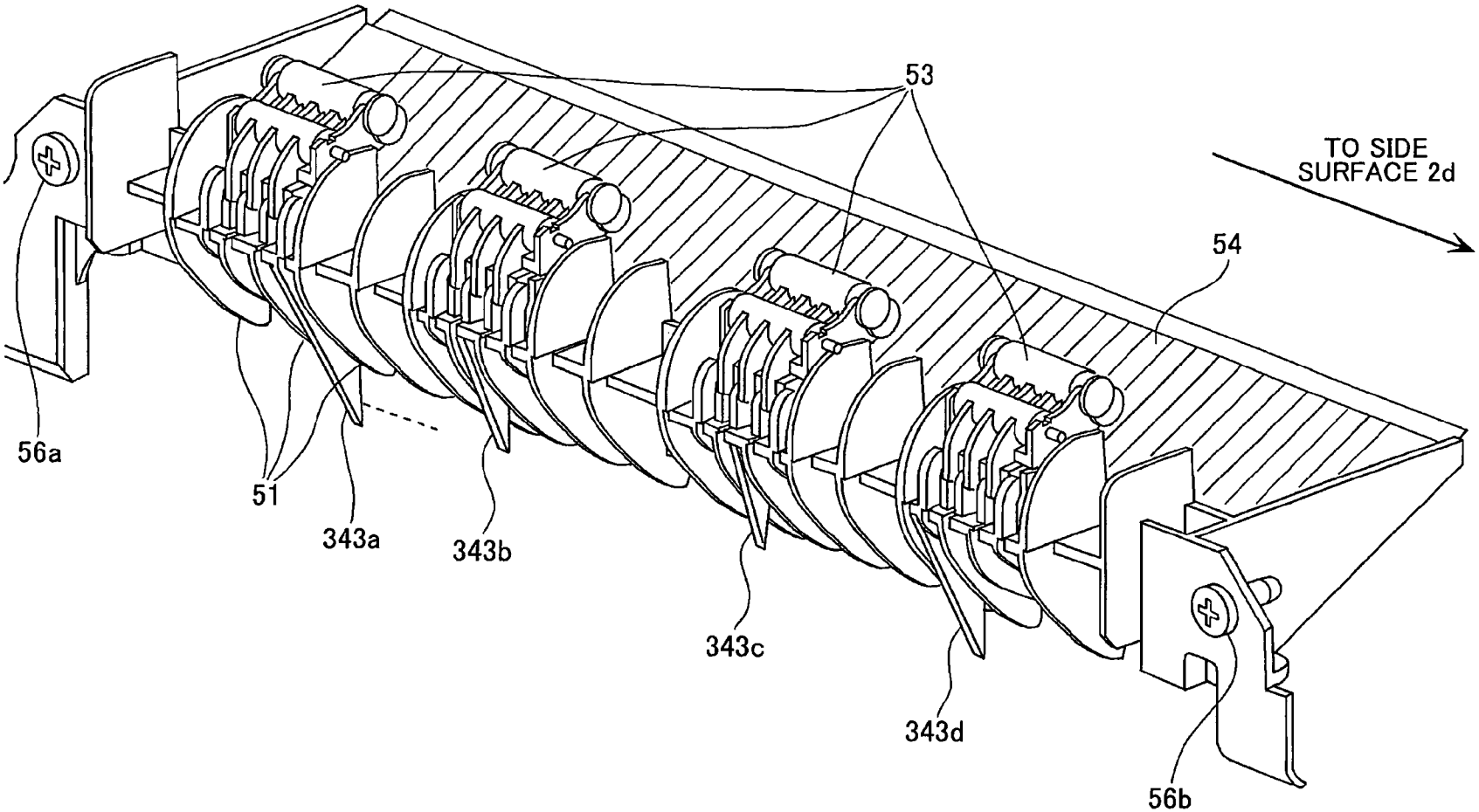
FIG. 13 is a perspective view illustrating the inner guide members.

As shown in FIG. 12, the drive gear 115 exposed in the opening 302 engages with a gear 400 through the opening 302. The gear 400 functions to transfer a driving force from a drive motor (not shown). Here, the opening 302 is provided on the opposite side of the heating roller 110 from the separating ribs 371 (only the rib 371*d* is shown in FIG. 12) when viewed along a rotational axis 112 of the heating roller 110. By providing the opening 302 at this position, pressure from the gear 400 when mounting the fixing unit 100 in the casing 2 causes the surface of the heating roller 110 to move closer to the separating ribs 371, contributing to an improvement in the separating performance of the separating ribs 371.

Next, the structure of the inner guide members 51 described above will be described. As is also illustrated in FIG. 2, the tray member 54 configures a portion of the depressed part formed in the sheet discharge tray 52 that receive into the casing 2. In this embodiment, the tray member 54 is integrally configured with the inner guide member 51 and the discharge rollers 53 that reversed the direction of the recording paper or other recording medium passing through the fixing unit 100 to proceed in a conveying direction towards the sheet discharge tray 52.

In addition to the inner guide members 51, separation preventing members 343*a*, 343*b*, 343*c*, and 343*d* are formed for preventing the separating pawls 340 from removing from the fixing unit 100. When fastening the inner guide members 51 inside the casing 2 with screws 56*a* and 56*b*, portions of the separation preventing members 343 are positioned in the grooves 342. With this construction, even when the separating pawls 340 move excessively from pressure received from the leading edge of the recording medium, the separating pawls 340 are stopped when contacting the separation preventing members 343. Hence, the separation preventing members 343 prevent separation of the separating pawls 340. The separation preventing members 343 may be formed separately from the inner guide members 51 and provided separately therebetween. Alternatively, the inner guide members 51 may be positioned to correspond with the grooves 342 and to extend downward themselves.

With this construction, the inner guide members 51 can be removed from the casing 2 in order to replace the separating pawls 340 without removing the fixing unit 100 from the casing 2. In this embodiment, the tray member 54 constituting part of the sheet discharge tray 52 is formed integrally with the inner guide members 51. Alternatively, the tray member 52 and the inner guide member 51 may also be configured separately.

(5) Method of Mounting the Temperature Fuse

A method of mounting a temperature fuse 389 in the case 130 will be described. The temperature fuse 389 includes a main fuse body 390 having an internal resinous part that melts at a high temperature, and lead wires 391*a* and 391*b* extending from both ends of the main fuse body 390. The other ends of the lead wires 391*a* and 391*b* have loops 392*a* and 392*b* to be fastened to screw holes 393*a* and 393*b*, respectively, by screws (not shown). Alternatively, it is also possible to attach the temperature fuse 389 by solder rather than screws.

The case 130 is also provided with plate-shaped rail members 376*a* and 376*b* for guiding the temperature fuse 389 into a fixed position on the bottom surface 135 when mounting the temperature fuse. The rail members 376*a* and 376*b* are provided substantially parallel to each other and protrude substantially perpendicularly from the bottom surface 135 toward the temperature fuse cover 375. The rail members 376*a* and 376*b* also span from the bottom surface 135 side of a gap 382 (see FIG. 10) to the bottom surface 135 side of the temperature fuse cover 375. The gap 382 allows the temperature fuse 389 to be mounted on top of the rail members 376*a* and 376*b*.

Figure 14A:
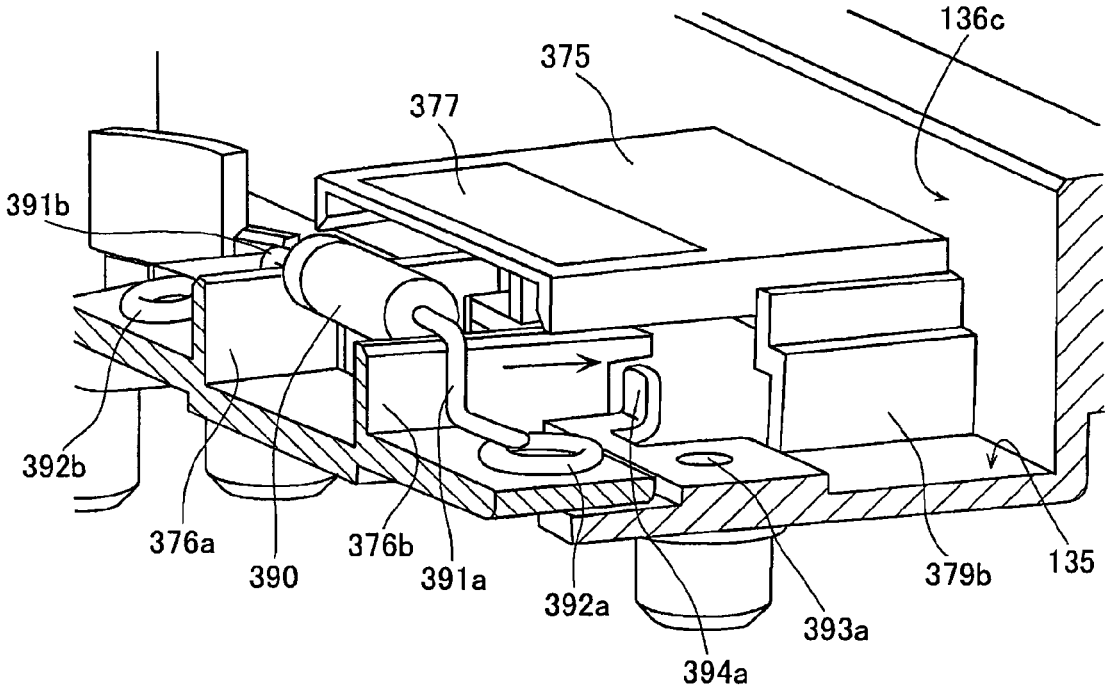
FIGS. 14(*a*) and 14(*b*) are perspective views showing a temperature fuse cover and illustrating a method of mounting the temperature fuse.
Figure 14B:
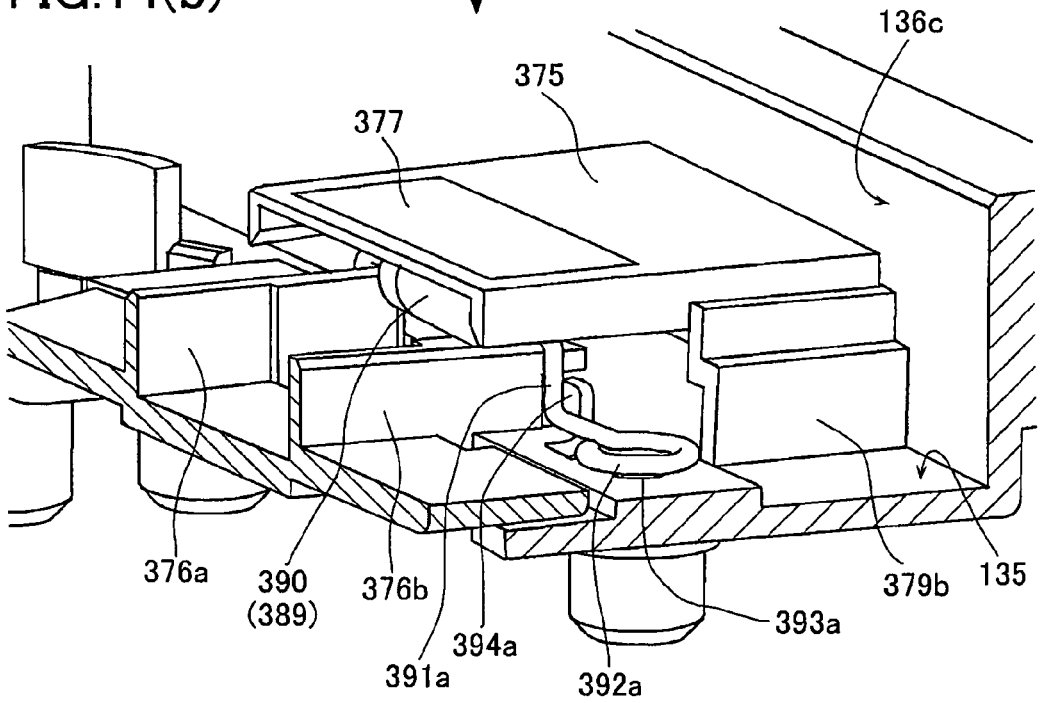

When mounting the temperature fuse 389, the temperature fuse 389 is placed with the lead wires 391*a* and 391*b* resting on top of the rail members 376*a* and 376*b* (FIG. 14(*a*)). Subsequently, the temperature fuse 389 is slid on the rail members 376*a* and 376*b* in the direction indicated by an arrow Y in FIG. 14(*a*) to a position at which a stopper 394*a* is provided (FIG. 14(*b*)). In this way, the temperature fuse 389 can be easily guided to a fixed position beneath the temperature fuse cover 375. Here, the guide parts are not limited to the rail members 376*a* and 376*b*. For example, a block member having a depression in which the main fuse body 390 can be mounted may be used. Alternatively, a downward slope may be provided from the bottom of the gap 382 toward the bottom of the temperature fuse cover 375, so that the temperature fuse slides down by its own weight.

While the invention has been described in detail with reference to preferred embodiments thereof, it would be apparent to those skilled in the art that many modifications and variations may be made therein without departing from the spirit of the invention, the scope of which is defined by the attached claims. For example, the following variations may also be implemented.

1) In the above embodiment, the rear cover 60 and the outer guide member 62 are configured as separate components, wherein the outer guide member 62 moves rearward in association with the opening of the rear cover 60. However, the outer guide member 62 may also be molded integrally with the rear cover 60.

2) In the above embodiment, the heating roller 110 is disposed above the pressure roller 120, and the pressure roller 120 is urged toward the heating roller 110 by the restorative force of the spring 160. However, the fixing unit 100 is not limited to this construction. It is also conceivable to dispose the pressure roller 120 above the heating roller 110 and to provide a mechanism for urging the pressure roller 120 toward the heating roller 110.

3) In the above embodiment, the tips 365 of the separating pawls 340 are pressed into contact with the surface of the heating roller 110 by the elastic force of the spring 363. However, another construction may be used to press the tips 365 against the surface of the heating roller 110. For example, the tips 365 may be pressed against the surface of the heating roller 110 by the weight of the separating pawls 340.

4) In the above embodiment, the separation preventing members 343 are disposed between the plurality of inner guide members 51. However, other members for preventing the separating pawls 340 from separating from the heating roller 110 may be used and there are no particular restrictions in the positions of these members. For example, depending on the shape of the sheet conveying path, separation preventing members may be provided integrally with the rear cover, or may be disposed so as to extend from the sheet discharge tray.

5) In the above embodiment, the support members 379*a* and 379*b* are integrally molded with the case 130. However, these components may be formed separately with the purpose of preventing warping or other deformation in the temperature fuse cover 375 and may be fixed by adhesion or bonding. Alternatively, the support members 379*a* and 379*b* may be fixed by screws formed of an insulating plastic or by another method.

6) above embodiment, the temperature fuse cover 375 is integrally molded with the case 130, but need not be configured this way. For example, an end of the temperature fuse cover 375 may be fixed to the side wall 136*c* by adhesive. Further, it is not necessary that the temperature fuse cover 375 be a substantially plate-shaped member.

What is claimed is:

1. A fixing unit, comprising:

a heating roller comprising a rotational axis having two ends, and a cylindrical surface;

a pressure roller comprising a rotational axis having two ends, and a cylindrical surface, the pressure roller being disposed in confrontation with the heating roller to press the cylindrical surface of the pressure roller against the cylindrical surface of the heating roller;

a case having two sides rotatably supporting the two ends of the heating roller, the case covering the heating roller on an opposite side of the pressure roller;

a pair of support members supported on the two sides of the case for rotatably supporting the rotational axis of the pressure roller, and a pair of elastic members that connect the pair of support members to the two sides of the case, each of the pair of elastic members generating a restorative force to press the pressure roller against the heating roller;

wherein the heating roller rotates to convey a recording medium in cooperation with the pressure roller, wherein the pressure roller is exposed without being covered by the case, wherein the pair of support members support the pressure roller, with two ends of the pressure roller being exposed and uncovered by the case, and wherein each of the pair of support members has two ends and an arc-shaped portion, one of the two ends being pivotably supported on the case, the other of the two ends being connected to the case through a corresponding one of the pair of elastic members, the arc-shaped portion having a shape extending along the cylindrical surface of the pressure roller and outside of the cylindrical surface of the pressure roller.

2. The fixing unit according to claim 1, wherein the pair of support members are configured to avoid the pressure roller from contacting a flat surface when the fixing unit is placed on the flat surface with the pressure roller on a bottom side.

3. The fixing unit according to claim 2, wherein each of the pair of support members comprises a portion that extends from a portion for supporting the pressure roller beyond the cylindrical surface of the pressure roller.

4. The fixing unit according to claim 1, wherein each of the pair of support members comprises a support portion that rotatably supports the pressure roller, the support portion preventing the pressure roller from contacting a flat surface when the case is placed on the flat surface with the pressure roller on a bottom side.

5. The fixing unit according to claim 1, further comprising a separating pawl provided in the case on a downstream side of a medium conveying direction of the recording medium, the separating pawl comprising a tip for contacting and pressing against the cylindrical surface of the heating roller.

6. The fixing unit according to claim 5, wherein the separating pawl comprises a rotational shaft having two engaged portions on two ends, each of the engaged portions comprising a semicylindrical portion and a flat portion to have a semicircular cross-section in a direction crossing an axial direction of the rotational shaft, the case comprises a holding portion provided at a position to mount the separating pawl, the holding portion providing a space for receiving a corresponding one of the engaged portions of the separating pawl, when the separating pawl is mounted, the engaged portion is inserted into the space under the holding portion while the flat portion faces the holding portion, the separating pawl is then rotated about the rotational shaft until the semicylindrical portion of the separating pawl fits into the holding portion.

7. The fixing unit according to claim 6, further comprising a spring wound around the rotational shaft, the spring having one end engaged with the case, and the spring pressing the tip of the separating pawl to the cylindrical surface of the heating roller.

8. The fixing unit according to claim 1, further comprising a separating rib provided integrally with the case on the downstream side of a medium conveying direction of the recording medium, the separating rib protruding to the cylindrical surface of the heating roller.

9. The fixing unit according to claim 8, further comprising: a drive gear provided on one of the ends of the heating roller, the drive gear driving the heating roller and being covered by the case, wherein the case further comprises an opening that allows the drive gear to be meshed with another gear in order to receive a driving force, the opening being formed on the opposite side of the case to the separating ribs with respect to the rotational axis of the heating roller, the cylindrical surface of the heating roller is positioned close to the separating ribs when the drive gear is meshed with the another gear through the opening.

10. The fixing unit according to claim 1, wherein the case comprises a thermistor for measuring a temperature of the cylindrical surface of the heating roller; and a wind-screening member provided integrally with the case and extending outward from the case so as to block wind from blowing on the thermistor.

11. An image-forming device comprising: the fixing unit according to claim 1; and an image-forming unit that provides a toner image on the recording medium, wherein the fixing unit fixes the toner images provided on the recording medium.

12. An image-forming device according to claim 11, further comprising: a main body that accommodates the fixing unit and the image-forming unit; and a separating pawl provided in the case on a downstream side of a medium conveying direction of the recording medium, the separating pawl comprising a tip for contacting and pressing against the cylindrical surface of the heating roller, a separation preventing member provided inside the main body that contacts and halts the separating pawl to prevent the separating pawl from removing from the case when the tip of the separating pawl moves by more than a predetermined distance in the median conveying direction.

13. An image-forming device according to claim 12, further comprising a plurality of inner guide members provided on a down stream side of the fixing unit in the medium conveying direction, the plurality of inner guide members being formed from semicircular plates, the plurality of inner guide members being configured to invert the medium conveying direction, at least one of the plurality of inner guide members having an end which is able to contact the separating pawl, the end of the at least one of the plurality of inner guide members functioning as the separation preventing member.

14. The fixing unit according to claim 1, further comprising: a temperature fuse spaced from the cylindrical surface of the heating roller, the temperature fuse interrupting power supply to the heating roller when the surface of the heating roller reaches an abnormal temperature; and a fuse cover provided between the heating roller and the temperature fuse, the fuse cover being formed integrally with the case.

15. The fixing unit according to claim 14, wherein the fuse cover is a formed from an electrically insulating material, thereby electrically insulating the temperature fuse from the heating roller.

16. The fixing unit according to claim 14, wherein the fuse cover comprises side surfaces protruding from the case, a flat main surface extending between the side surfaces and parallel to the case, and an opening surrounded by one end of each of the side surfaces and the main surface, the case further comprises a pair of guide members that guide the temperature fuse to a space between the fuse cover and the case through the opening.

17. An image-forming device comprising: a fixing unit according to claim 14; and an image-forming unit that forms a toner image on the recording medium.

* * * * *